US005712072A

United States Patent [19]

Inaba et al.

[11] Patent Number: 5,712,072

[45] Date of Patent: Jan. 27, 1998

[54] TONER FOR DEVELOPING ELECTROSTATIC IMAGE

[75] Inventors: Kohji Inaba, Yokohama; Tatsuya Nakamura, Tokyo; Tatsuhiko Chiba, Kamakura; Kengo Hayase, Tokyo, all of Japan

[73] Assignee: Canon Kabushiki Kaisha, Tokyo, Japan

[21] Appl. No.: 605,737

[22] Filed: Feb. 22, 1996

[30] Foreign Application Priority Data

Feb. 28, 1995 [JP] Japan ..... 7-063602
Feb. 28, 1995 [JP] Japan ..... 7-063604

[51] Int. Cl.[6] ..... G03G 9/08; G03G 9/087; G03G 9/093

[52] U.S. Cl. ..... 430/110; 430/109; 430/111; 430/137

[58] Field of Search ..... 430/110, 109, 430/111, 137

[56] References Cited

U.S. PATENT DOCUMENTS

| | | | |
|---|---|---|---|
| 2,297,691 | 10/1942 | Carlson | 430/55 |
| 4,299,899 | 11/1981 | Azar et al. | 430/108 |
| 4,917,982 | 4/1990 | Tomono et al. | 430/99 |
| 4,921,771 | 5/1990 | Tomono et al. | 430/110 |
| 5,314,777 | 5/1994 | Watanabe et al. | 430/106 |
| 5,476,745 | 12/1995 | Nakamura et al. | 430/137 |
| 5,510,222 | 4/1996 | Inaba et al. | 430/109 |
| 5,604,072 | 2/1997 | Unno et al. | 430/110 |

FOREIGN PATENT DOCUMENTS

| | | | |
|---|---|---|---|
| 0470479 | 2/1992 | European Pat. Off. . | |
| 0533172 | 3/1993 | European Pat. Off. . | |
| 0627669 | 7/1994 | European Pat. Off. . | |
| 0621511 | 10/1994 | European Pat. Off. . | |
| 0658816 | 6/1995 | European Pat. Off. . | |
| 36-10231 | 7/1961 | Japan . | |
| 42-23910 | 11/1967 | Japan . | |
| 43-24748 | 10/1968 | Japan . | |
| 52-3304 | 1/1977 | Japan . | |
| 52-3305 | 1/1977 | Japan . | |
| 56-13945 | 1/1981 | Japan . | |
| 57-52574 | 11/1982 | Japan . | |
| 59-53856 | 3/1984 | Japan . | |
| 59-61842 | 4/1984 | Japan | G03G 9/08 |
| 1-185660 | 7/1989 | Japan | G03G 9/08 |
| 1-185661 | 7/1989 | Japan | G03G 9/08 |
| 1-185662 | 7/1989 | Japan | G03G 9/08 |
| 1-185663 | 7/1989 | Japan | G03G 9/08 |
| 1-238672 | 9/1989 | Japan . | |
| 4-107467 | 4/1992 | Japan . | |
| 4-149559 | 5/1992 | Japan | G03G 9/087 |
| 4-301853 | 10/1992 | Japan | G03G 9/08 |
| 5-61238 | 3/1993 | Japan | G03G 9/08 |

OTHER PUBLICATIONS

R.F. Fedors, "A Method for Estimating . . . Liquids", Polym. Eng. and Sci., vol. 14, No. 2, Feb. 1974, pp. 147–152.

W.A. Lee et al., "The Glass Transition Temperatures of Polymers", Polymer Handbook, 2nd Ed., publ. by John Wiley & Sons, pp. (III–179)–(III–192).

*Primary Examiner*—Janis L. Dote

*Attorney, Agent, or Firm*—Fitzpatrick, Cella, Harper & Scinto

[57] ABSTRACT

The present invention relates to a toner for developing an electrostatic image, comprising toner particles containing a binding resin composed of a styrene homopolymer or copolymer, a coloring agent, a polar resin, and a specified solid ester wax.

23 Claims, 2 Drawing Sheets

SECTIONS OF TONER PARTICLES

SECTIONS OF TONER PARTICLES

TONER FOR DEVELOPING ELECTROSTATIC IMAGE

BACKGROUND OF THE INVENTION

Field of the Invention and Related Art

The present invention relates to a toner for developing an electrostatic image suitable for thermal fixing which is used for image-forming method, such as electrophotography and electrostatic recording process.

Various methods on electrophotography have been known as disclosed in, for example, U.S. Pat. No. 2,297,961, and Japanese Examined Patent Nos. 42-23910 and 43-24748. A general electrophotographic process uses a photoconductive material and includes the following steps to obtain a copy or print; forming electrostatic image on a photosensitive member by various means; developing the electrostatic image with toners; transferring the toner image on a transferring member such as paper by using any direct or indirect means as needed; and fixing the transferred image with heat, pressure, heat under pressure, or solvent steam. After the remaining toner on the photosensitive member is removed by any means, the above steps are repeated.

A general method for forming full-color image will be explained. A photosensitive drum is charged by a first charger, an image is exposed on the photosensitive drum with laser light which is modulated by magenta image signals from an original document to form an electrostatic image on the photosensitive drum, the electrostatic image is developed with a magenta developer containing magenta toner to form a magenta toner image. The magenta toner image which is developed on the photosensitive drum is transferred directly or indirectly on a transferring member with a transferring charger.

On the other hand, the photosensitive drum after the development of the electrostatic image is discharged by using a discharger, and cleaned by a cleaning means, again charged with the charger to form a similar cyan toner image, and the cyan toner image is transferred to the transferring member on which the magenta toner image has been transferred. Further, on yellow and black colors, developing and transferring steps are similarly applied to form a four-color toner image on the transferring member. The four-color toner image on the transferring member is fixed with heat and pressure by using a fixing roll to form a full-color image on the transferring member.

Another method to form a full-color image on the transferring member includes the following steps; transferring the magenta toner image on an intermediate member from the photosensitive member; separately transferring the cyan, yellow and black toner images on the intermediate member; transferring four color toner images from the intermediated member to the transferring member; and fixing the four color toner images on the transferring member with the fixing roller by means of the effects of heat and pressure.

Demand for double-sided copying wherein images are formed on both sides of transferring paper is now increasing day by day in order to reduce the consumption of the transferring paper, reflecting recent boom in ecology.

Required characteristics for toners, which are used for full-color copying machines or full-color printers, are improved color reproducibility, and sufficient mixing properties of each toner in the fixing step with heat and pressure without transparency loss of an over-head projector(OHP) image. In the toner for full-color image, a low molecular weight binding resin having a sharp melt characteristic is preferred compared with black toner for general monochrome copying machines. However, when using the binding resin having a sharp melt characteristic, troubles on the high temperature offset resistance often occur during the toner melting in the fixing step with heat and pressure due to its low self cohesive force. In general for black toners for the monochrome coping machines, relatively high-crystalline waxes represented by polyethylene wax and polypropylene wax are used as a releasing agent in order to improve the high temperature offset resistance during fixing, as proposed in, for example, Japanese Examined Patent Nos. 52-3304 and 52-3305, and Japanese Examined Patent No. 57-52574. However, when such waxes are used in the toner for full-color image, the transparency on the OHP projection is hampered and the color saturation and brilliancy of the projected images decrease, due to high crystallinity of the releasing agent itself and the difference of the refractive index between the releasing agent and the OHP sheet material.

Methods for decreasing the crystallinity of waxes by means of the use of nucleation agents with waxes have been proposed in Japanese Laid-Open Patent Nos. 4-149559 and 4-107467 to solve these problems. Methods, in which waxes having a lower crystallinity are used, are disclosed in Japanese Laid-Open Patent Nos. 4-301853 and 5-61238. The use of montan waxes having relatively high transparency and a low melting point are proposed in Japanese Laid-Open Patent Nos. 1-185660, 1-185661, 1-185662, 1-185663, and 1-238672. These waxes, however, do not always satisfy sufficiently all the transparency on the OHP, low temperature fixing properties on fixing with heat and pressure, and high temperature offset resistance. Therefore, in conventional color toners, the improvement of the high temperature offset resistance and the transparency of the OHP are intended by painting oils such as silicone oil and fluorine oil on the fixing roll with heat, and by adding the releasing agent as little as possible. The excessive oil, however, adheres on the resulting fixed image. The oil may contaminate the photosensitive member and swell the fixing roll, resulting in decreased life of the fixing roll. Further, homogeneous and quantitative oil feeding on the fixing roll is required in order to prevent linear adhesion of oil on the fixed image, so that the fixing device has a trend toward a larger size.

Thus, development of a toner having the following advantages has been waited eagerly: In the fixing means with heat and pressure using no oil or reduced amount of oil to prevent the high temperature offset, the offset is reduced and the transparency of the fixed image is excellent.

Moreover, in the double-sided copying operations, a toner having a further improved high temperature offset resistance compared with toners used for single-sided copying has been waited eagerly, since the first copying image passes through fixing steps with heat and pressure twice.

SUMMARY OF THE INVENTION

It is an object of the present invention to provide a toner for developing an electrostatic image of which the above-mentioned problems are solved.

It is another object of the present invention to provide a toner for developing an electrostatic image having a large coloring strength.

It is a further object of the present invention to provide a toner for developing an electrostatic image having an excellent offset resistance, in particular, an excellent offset resistance on fixing.

It is still another object of the present invention to provide a toner for developing an electrostatic image which can fix satisfactorily the toner image on the transferring member by painting a small amount of oil or no oil on the fixing roll.

It is a still further object of the present invention to provide a toner for developing an electrostatic image having an excellent blocking resistance.

It is another object of the present invention to provide a color toner for developing an electrostatic image having a large coloring strength.

It is a further object of the present invention to provide a color toner for developing an electrostatic image having a large coloring strength.

It is a still further object of the present invention to provide a color toner for developing an electrostatic image having an excellent offset resistance, in particular, an excellent offset resistance on fixing.

It is still another object of the present invention to provide a color toner for developing an electrostatic image which can fix satisfactorily the toner image on the transferring member by painting a small amount of oil or no oil on the fixing roll.

It is a still further object of the present invention to provide a color toner for developing an electrostatic image having an excellent blocking resistance.

It is still another object of the present invention to provide a color toner for developing an electrostatic image having an excellent transparency on the OHP and excellent high temperature offset resistance.

It is further object of the present invention to provide a color toner for developing an electrostatic image having excellent low temperature fixing properties.

It is another object of the present invention to provide a color toner for developing an electrostatic image which causes no image defect on double-sided fixing.

These and other objects are attained by a toner for developing an electrostatic image, comprising: toner particles containing a binding resin composed of a styrene homopolymer or copolymer, a coloring agent, a polar resin, and a solid ester wax represented by the following general formula (A) or (B):

$$R_1-O-\underset{\underset{O}{\|}}{C}-R^2-\underset{\underset{O}{\|}}{C}-O-R_3 \qquad (A)$$

wherein $R_1$ and $R_3$ represent organic groups each having 6 to 32 carbon atoms, $R_1$ and $R_3$ may be the same or different, and $R_2$ represents an organic group having 4 to 20 carbon atoms:

$$R_4-O-\underset{\underset{O}{\|}}{C}-R^5-\underset{\underset{O}{\|}}{C}-O-R_6 \qquad (B)$$

wherein $R_4$ and $R_6$ represent organic groups each having 6 to 32 carbon atoms, $R_4$ and $R_6$ may be the same or different, and $R_5$ represents an organic group selected from the group consisting the following groups (1), (2), and (3):

$$-CH_2CH_2OC_6H_4OCH_2CH_2-; \qquad (1)$$

$$-(CH(CH_3)CH_2O)_n-C_6H_4-\overset{\overset{CH_3}{|}}{\underset{\underset{CH_3}{|}}{C}}-C_6H_4-(OCH_2CHCH_3)_n- \qquad (2)$$

wherein n represents an integer not less than 1;

$$-(CH_2)_m \qquad (3)$$

wherein m represents an integer of 4 to 20.

DETAILED DESCRIPTION OF THE PREFERRED EMBODIMENTS

Figure 1:
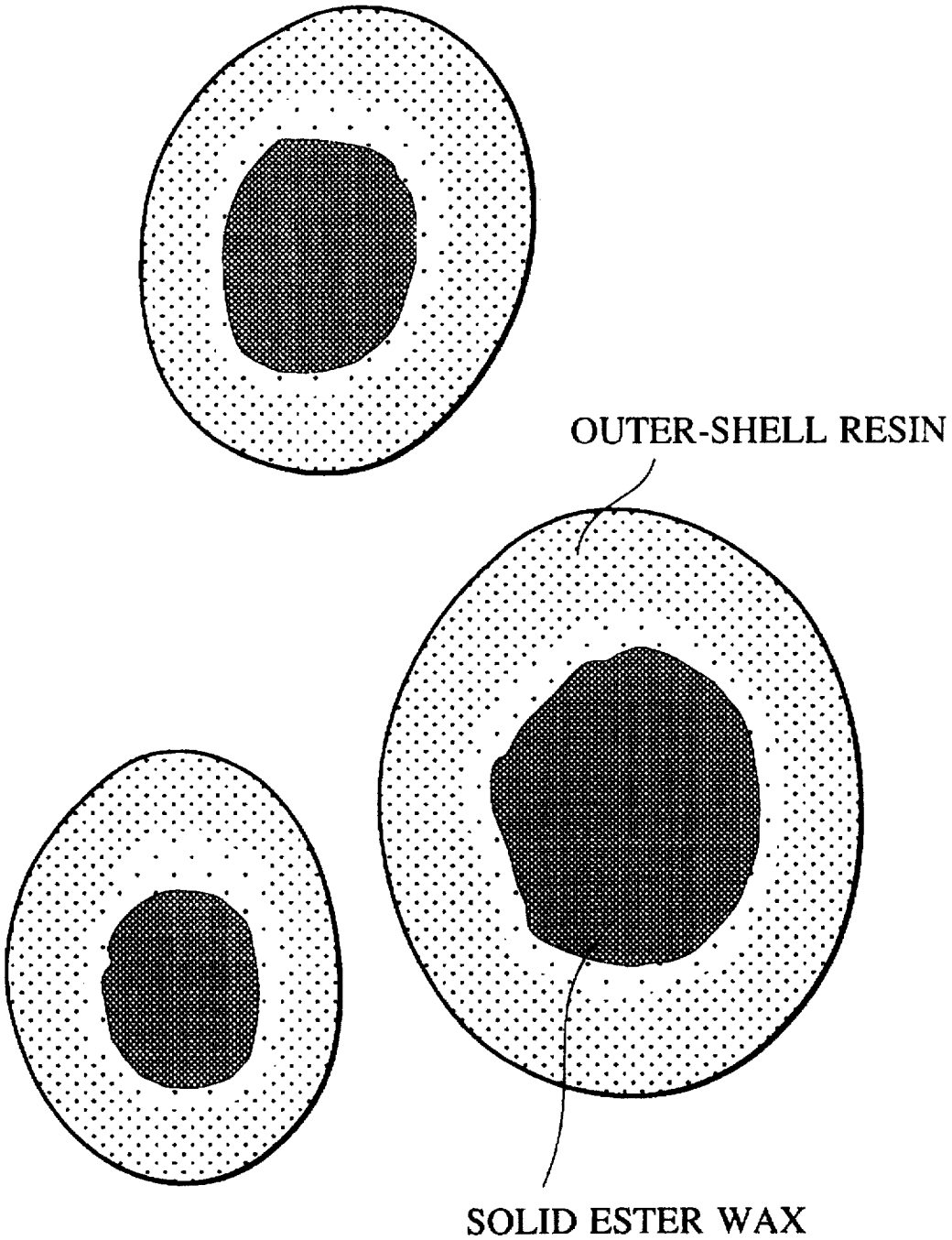
FIG. 1 is a schematic illustration of toner particles including solid ester wax in the core.

In order to improve the low temperature fixing properties and the offset resistance and to obtain an excellent transparency of the fixed color image on the OHP film, the toner of the present invention contains a solid ester wax represented by the following general formula (A) or (B):

$$R_1-O-\underset{\underset{O}{\|}}{C}-R^2-\underset{\underset{O}{\|}}{C}-O-R_3 \qquad (A)$$

wherein $R_1$ and $R_3$ represent organic groups each having 6 to 32 carbon atoms, $R_1$ and $R_3$ may be the same or different, and $R_2$ represents an organic group having 4 to 20 carbon atoms:

$$R_1-O-\underset{\underset{O}{\|}}{C}-R^2-\underset{\underset{O}{\|}}{C}-O-R_3 \qquad (A)$$

wherein $R_4$ and $R_6$ represent organic groups each having 6 to 32 carbon atoms, $R_4$ and $R_6$ may be the same or different, and $R_5$ represents an organic group selected from the group consisting the following groups (1), (2), and (3):

$$-CH_2CH_2OC_6H_4OCH_2CH_2-; \qquad (1)$$

$$-(CH(CH_3)CH_2O)_n-C_6H_4-\overset{\overset{CH_3}{|}}{\underset{\underset{CH_3}{|}}{C}}-C_6H_4-(OCH_2CHCH_3)_n- \qquad (2)$$

wherein n represents an integer not less than 1;

$$-(CH_2)_m \qquad (3)$$

wherein m represents an integer of 4 to 20.

It is preferred that the solid ester wax has a main peak (hereinafter "melting point") at a temperature of 40° to 90° C., and most suitably 55° to 85° C., in an endothermogram obtained by ASTM D3418-8 to improve the low temperature fixing properties and offset resistance of the toner. The measurement according to ASTM D3418-8 can be carried out, for example, by Perkin Elmer DSC-7. The temperature of the detector section of the instrument may be calibrated with the melting points of indium and zinc and the quantity of heat may be calibrated with the heat of fusion of indium. The sample is packed in an aluminum pan, and an empty pan is used as the reference. The measurement is carried out from 20° to 200° C. at the heating rate of 10° C./min.

It is preferred that the solid ester wax has a solubility parameter (SP) ranging from 7.5 to 10.5. The solubility parameter (SP) may be calculated, for example, by Fedors' method in which the additivity of atomic groups is used for the calculation [Polymer Eng. Sci., 14(2), 147(1974)]. When the SP of the solid ester wax is between 7.5 to 10.5, the solid ester wax in toner particles hardly adhere to the surface of carrier particles and the developing sleeve, triboelectric chargeability becomes stable, fog hardly occurs, and the fluctuation of image density on toner supplying can be suppressed. Further, the blocking of the toner is suppressed after storing during the summer season, the offset can be effectively prevented even in double-sided fixing since the ester wax forms a releasing layer on the fixing surface on fixing with heat and pressure.

The melt viscosity at 130° C. of the soled ester wax is preferably in the range of 1 to 300 cPs, and more preferably 3 to 50 cPs. The ester wax having a melt viscosity not greater than 1 cPs readily causes the sleeve contamination due to a mechanical shearing force, when a thin toner layer is applied on the sleeve by using a coating blade in a nonmagnetic one-component developing method. Damages due to shear force between toner particles and carrier particles also readily occurs when developing by using carrier in a two component type developing method, often resulting in imbedding of additives into the toner particle surface and toner breakage. When the solid ester wax has a melt viscosity over 300 cPs, the viscosity of polymerizable monomer composition during the toner production by means of a polymerization method becomes too high to obtain easily fine toner particles each having a homogeneous particle size, resulting in the formation of toner particles having a widespread particle size distribution. The melt viscosity of the ester wax may be measured by HAAKE VP-500 with a corn plate type rotor (PK-1) at 130° C.

It is preferred that the solid ester wax has a Vickers hardness ranging from 0.3 to 5.0, and in particular, from 0.5 to 3.0. The toner containing the solid ester wax having a Vickers hardness of not greater than 0.3 easily breaks at the cleaning section of the copying machine during durability test in which many copying operations are repeated, so that toner melting on the drum surface is often observed, resulting in black line formation on the image. Further, when many fixed image sheets are stored together, fixed toner tends to transfer to another sheet. On the other hand, the toner containing the solid ester wax having a Vickers hardness exceeding 5.0 requires a high pressure during fixing with heat and pressure.

The hardness of the solid ester wax is determined, for example, with Shimadzu Dynamic Micro Hardness Meter (DUH-200). After displacement of 10 μm at a loading speed of 9.67 mg/sec under the loading of 0.5 g by Vickers penetrator, the sample is allowed to stand for 15 seconds, and the Vickers hardness is determined by the analysis of the scar formed on the sample. The melt sample is molded with a mold having a diameter of 20 mm to a cylindrical shape having a thickness of 5 mm to prepare a molded sample for use in the measurement.

The solid ester wax added is preferably 5 to 40 parts by weight, and more preferably 10 to 30 parts by weight, into 100 parts by weight of the binding resin, considering the case of double-sided fixing. "Double-sided fixing" means to form a fixed image on one side of the copying paper or printing paper, then to form another fixed image on the back side of the copying paper or printing paper. Since the first fixed image passes through the fixer twice, a sufficient high temperature offset resistance is required for the toner. Therefore, a significant amount of the solid ester wax is preferably added in the present invention. The addition of less than 5 parts by weight decreases the high temperature offset resistance and low temperature fixing properties. Further, offset is often observed in the image on the back side during double-sided fixing. When exceeding 40 parts by weight, the toner easily melts during toner production by a pulverizing process, or toner particles tends to make aggregates of each other during granulation by a polymerization process. As a result, both methods form a toner having a wide particle size distribution. Moreover, the addition exceeding 40 parts by weight decreases the toner durability.

A preferred method to involve a significant amount of the solid ester wax inside each of the toner particles is the formation of the toner particles by the polymerization of emulsion particles of a monomer composition containing the solid ester wax in an aqueous medium. According to this method, toner particles having a shell-core structure, in which the solid ester wax forms a nuclei and the binding resin forms an outer shell, is effectively formed as shown in FIG. 1, which is a section of toner particles observed with transmission electron microscopy. Such toner particle containing the ester wax therein is preferred to satisfy fixing properties at a low temperature, and blocking properties and durability of the toner. It is difficult to prepare toner particles containing much ester wax satisfactorily by a pulverizing method unless by applying a special freezing pulverization, thus particle size distribution becomes wider and melt adhesion of toners to the apparatus may occur. Further, the freezing pulverization needs a complicated apparatus to prevent condensation in the apparatus. When the toner absorbs moisture, workability for toner production decreases and additional drying process may be added.

An example for observing the section of toner particles includes the following steps; toner particles are thoroughly dispersed into a cold setting epoxy resin; the resin is hardened at 40° C. for two days; the hardened sample is stained with ruthenium tetroxide and optionally osmium tetroxide; the sample is cut to thin specimens by using a microtome with a diamond blade; the thin specimens are mounted to observe the section of toner particles by using a transmission electron microscope. Staining with ruthenium tetroxide is preferably used to obtain a high contrast between materials, by means of the difference in crystallinities of the ester wax and the outer shell resin.

In the solid ester wax (A), it is preferred, considering low temperature fixing properties and high temperature offset resistance of toner, that the number of carbon atoms of $R_1$ and $R_3$ is from 10 to 25, the number of carbon atoms of $R_2$ is from 6 to 18, and the number of total carbon atoms is 28 or more. Each of $R_1$ and $R_3$ may be preferably an alkyl group, and $R_2$ may be preferably an alkylene group.

Examples of the solid ester wax (A) are as follows:

Solid ester wax (A-1)

$$CH_3-(CH_2)_{17}-O-\underset{\underset{O}{\|}}{C}-(CH_2)_4-\underset{\underset{O}{\|}}{C}-O-(CH_2)_{17}-CH_3$$

Solid ester wax (A-2)

$$CH_3-(CH_2)_{21}-O-\underset{\underset{O}{\|}}{C}-(CH_2)_4-\underset{\underset{O}{\|}}{C}-O-(CH_2)_{21}-CH_3$$

Solid ester wax (A-3)

$$CH_3-(CH_2)_{11}-\underset{\underset{O}{\|}}{C}-(CH_2)_4-\underset{\underset{O}{\|}}{C}-O-(CH_2)_{21}-CH_3$$

Solid ester wax (A-4)

$$CH_3-(CH_2)_{17}-O-\underset{\underset{O}{\|}}{C}-(CH_2)_8-\underset{\underset{O}{\|}}{C}-O-(CH_2)_{17}-CH_3$$

Solid ester wax (A-5)

$$CH_3-(CH_2)_{21}-O-\underset{\underset{O}{\|}}{C}-(CH_2)_8-\underset{\underset{O}{\|}}{C}-O-(CH_2)_{21}-CH_3$$

-continued

Solid ester wax (A-6)

$$CH_3-(CH_2)_{17}-O-\underset{\underset{O}{\|}}{C}-(CH_2)_{18}-\underset{\underset{O}{\|}}{C}-O-(CH_2)_{17}-CH_3$$

TABLE 1

| Wax | Melting Point(°C.) | Solubility Parameter | Vickers Hardness | Melt Viscosity at 130° C.(cPs) |
|---|---|---|---|---|
| Solid ester wax (A-1) | 67 | 8.8 | 2.8 | 5.7 |
| Solid ester wax (A-2) | 75 | 8.8 | 2.9 | 6.0 |
| Solid ester wax (A-3) | 65 | 8.8 | 2.8 | 5.7 |
| Solid ester wax (A-4) | 71 | 8.8 | 2.9 | 5.9 |

TABLE 1-continued

| Wax | Melting Point(°C.) | Solubility Parameter | Vickers Hardness | Melt Viscosity at 130° C.(cPs) |
|---|---|---|---|---|
| Solid ester wax (A-5) | 79 | 8.8 | 3.0 | 6.1 |
| Solid ester wax (A-6) | 81 | 8.8 | 3.0 | 6.2 |

In the solid ester wax (B), it is preferred, considering low temperature fixing properties and high temperature offset resistance of toner, that the number of carbon atoms of $R_4$ and $R_6$ is from 10 to 25, and the number of total carbon atoms is 28 or more $R_4$ and $R_6$ are each preferably an alkyl group. When $R_5$ is $-(CH_2)_n-$, n is preferred to be from 6 to 18, considering low temperature fixing properties and high temperature offset.

Examples of the solid ester wax (B) are as follows:

Solid ester wax (B-1)

$$CH_3-(CH_2)_{20}-\underset{\underset{O}{\|}}{C}-O-CH_2-CH_2-O-C_6H_4-O-CH_2-CH_2-O-\underset{\underset{O}{\|}}{C}-(CH_2)_{20}-CH_3$$

Solid ester wax (B-2)

$$CH_3-(CH_2)_{20}-\underset{\underset{O}{\|}}{C}-O-CH_2-CH_2-O-C_6H_4-O-CH_2-CH_2-O-\underset{\underset{O}{\|}}{C}-(CH_2)_{20}-CH_3$$

Solid ester wax (B-3)

$$CH_3-(CH_2)_{10}-\underset{\underset{O}{\|}}{C}-O-CH_2-CH_2-O-C_6H_4-O-CH_2-CH_2-O-\underset{\underset{O}{\|}}{C}-(CH_2)_{10}-CH_3$$

Solid ester wax (B-4)

$$CH_3-(CH_2)_{16}-\underset{\underset{O}{\|}}{C}-O-(\underset{\underset{CH_3}{|}}{CH}-CH_2-O)-\overset{\overset{CH_3}{|}}{\underset{\underset{CH_3}{|}}{C}}-C_6H_4-(O-CH_2-\underset{\underset{CH_3}{|}}{CH})-O-\underset{\underset{O}{\|}}{C}-(CH_2)_{16}-CH_3$$

Solid ester wax (B-5)

$$CH_3-(CH_2)_{21}-\underset{\underset{O}{\|}}{C}-O-(\underset{\underset{CH_3}{|}}{CH}-CH_2-O)-\overset{\overset{CH_3}{|}}{\underset{\underset{CH_3}{|}}{C}}-C_6H_4-(O-CH_2-\underset{\underset{CH_3}{|}}{CH})-O-\underset{\underset{O}{\|}}{C}-(CH_2)_{21}-CH_3$$

Solid ester wax (B-6)

$$CH_3-(CH_2)_{16}-\underset{\underset{O}{\|}}{C}-O-(CH_2-CH_2)_4-O-\underset{\underset{O}{\|}}{C}-(CH_2)_{16}-CH_3$$

Solid ester wax (B-7)

$$CH_3-(CH_2)_{20}-\underset{\underset{O}{\|}}{C}-O-(CH_2-CH_2)_4-O-\underset{\underset{O}{\|}}{C}-(CH_2)_{20}-CH_3$$

Solid ester wax (B-8)

$$CH_3-(CH_2)_{10}-\underset{\underset{O}{\|}}{C}-O-(CH_2-CH_2)_4-O-\underset{\underset{O}{\|}}{C}-(CH_2)_{10}-CH_3$$

Solid ester wax (B-9)

$$CH_3-(CH_2)_{18}-\underset{\underset{O}{\|}}{C}-O-(CH_2-CH_2)_9-O-\underset{\underset{O}{\|}}{C}-(CH_2)_{18}-CH_3$$

-continued

Solid ester wax (B-10)

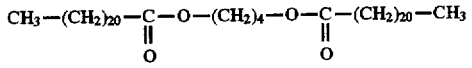

Solid ester wax (B-11)

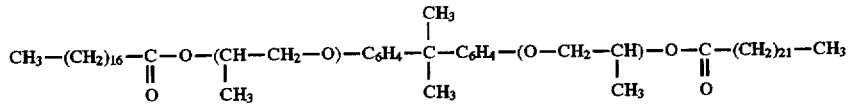

The solid polyester wax used in the present invention may be prepared by the following methods; synthesis by oxidation; synthesis from an carboxylic acid a its derivatives; ester group-introducing reaction, such as Michael addition reaction; dehydration condensation of a carboxylic acid and alcohol; reaction of an acid halide with alcohol; and ester exchanging reaction. Examples of preferred catalysts may include typical acidic and alkaline catalysts used for esterification, for example, zinc acetate and titanium compounds. Both equimolar reaction and non-equimolar reaction, in which either of acid or alcohol is extremely excessively added, may be available. After the reaction, any purification process, such as recrystallization and distillation, may be employed as needed.

Examples of the binding resins used in the present invention include styrene homopolymer or copolymer, such as polystyrene, styrene-(meth)acrylate copolymers, and styrene-butadiene copolymers. When obtaining toner particles by a direct polymerization, preferred monomers may be styrene monomer and other styrene derivative monomers, such as styrene, (o-, m-, and p-)methylstyrene, (m- and p-)ethylstyrene; (meth)acrylic monomers such as methyl (meth)acrylate, ethyl (meth)acrylate, propyl (meth)acrylate, butyl (meth)acrylate, octyl (meth)acrylate, dodecyl (meth) acrylate, stearyl (meth)acrylate, behenyl (meth)acrylate,2-ethylhexyl (meth)acrylate, dimethylaminoethyl (meth) acrylate, and diethylaminoethyl (meth)acrylate; and diene monomers, such as butadiene, isoprene, cyclohexene, (meth)acrylonitrile, and acrylic amide. These monomers may be used solely or as a mixture having a theoretical glass transition temperature, which is described in pages 139–192 of "Polymer Handbook" second edition III (by John Wiley & Sons), of 40° to 75° C. When the theoretical glass transition point of the binding resin is less than 40° C., storage stability and durability of the toner often decrease, while the theoretical glass transition point exceeding 75° C. causes increased fixing temperature. In particular, color mixing of each color, color reproducibility, and the transparency of the OHP film image decrease in the full-color toner system.

The molecular weight of the binding resin is determined by gel permeation chromatography (GPC). Example of GPC is as follows; the toner is extracted with toluene by Soxhlet extraction method; toluene is removed with a rotary evaporator; the toner is thoroughly washed with an organic solvent, such as chloroform, which can dissolve the ester wax, but not dissolve the binding resin; the remaining solid component is dissolved into tetrahydrofuran (THF); the THF solution is filtered with a solvent-resistant membrane filter having a pore size of 0.3 μm; and the solution is fed into Waters 150 C GPC with a column series consisting of Showa Denko A-801,802, 803, 804,805,806, and 807. The molecular weight is calibrated with standard polystyrene polymers. The THF-soluble component has preferably a number-average molecular weight (Mn) of 5,000 to 1,000,000 and a ratio (Mw/Mn) of a weight-average molecular weight (Mw) to the number-average molecular weight (Mn) of 2 to 100.

In the present invention, it is preferred that the solid ester wax is encapsulated inside the binding resin. Thus, the addition of a polar resin into the toner particles is effective. Preferred examples of polar resin used in the present invention may include copolymers of styrene with (meth)acrylic acid, copolymers of maleic acid, saturated polyester resins, epoxy resins. Particularly, the polar resins not containing unsaturated groups which are reactive with the binding resin or monomer are preferred. When the polar resins having any unsaturated groups, excessive crosslinking will occur in the monomers forming the binding resin, so the color mixing unsatisfactorily decreases.

As a black coloring agent in the present invention, carbon black, magnetic materials, mixed black coloring agents made of yellow, magenta and cyan coloring agents may be used.

Typical examples of the yellow coloring agents used are fused ring azo compounds, isoindolinone compounds, anthraquinone compounds, azo metallic complexes, methine compounds, and arylamide compounds; preferably including C. I. Pigment Yellow 12, 13, 14, 15, 17, 62, 74, 83, 93, 94, 95, 97, 109, 110, 111, 120, 127, 128, 129, 147, 168, 174, 176, 180, 181, and 191.

Magenta coloring agents used are fused ring azo compounds, diketopyrrolopyrrole compounds, anthraquinone compounds, quinacridone compounds, thioindigo compounds, and perylene compounds. Examples of preferable magenta pigments are C. I. Pigment Red 2, 3, 5, 6, 7, 23, 48; 2, 48; 3, 48; 4, 57; 1, 81; 1, 144, 146, 166, 169, 177, 184, 185, 202, 206, 220, 221, and 254.

Cyan coloring agents used are copper phthalocyanine compounds, anthraquinone compounds, and base dyestuff lake compounds. Examples of preferable cyan pigments are C. I. Pigment Blue 1, 7, 15, 15: 1, 15: 2, 15: 3, 15: 4, 60, 62 and 66.

These coloring agents may be used solely, as a mixture, or as a solid solution. The coloring agents of the present invention are selected in consideration of hue angle, color saturation, brilliancy, weatherability, transparency on the OHP film, and dispersibility into the toner particles. Generally 1 to 20 parts by weight of coloring agent may be added into 100 parts by weight of the binding resin.

When a magnetic material is used as a black coloring agent, 40 to 150 parts by weight of the magnetic material is added into 100 parts by weight of the binding resin, differing from other coloring agents.

Preferred charge controlling agents which are used to stabilize the triboelectric chargeability are colorless charge controlling agents having high charging speed and stably maintaining the predetermined charge quantity. Further, when direct polymerization is employed in the present invention, charge controlling agents, not having polymerization hindrance and soluble components into an aqueous medium, are preferably used. Examples of charge controlling agents may include negative controlling agents, such as salicylic acid, and alkylsalicylic acid, dialkylsalicylic acid, naphtoic acid, metallic compounds of dicarboxylic acids, polymeric compounds having side sulfonic acid or carboxylic acid groups, boron compounds, urea compounds, silicon compounds, and calixarene; and positive controlling agents, such as quaternary ammonium salts, polymeric compounds having these quaternary ammonium salts as side chains, guanidine compounds, and imidazole compounds. The preferred content of the charge controlling agent ranges from 0.5 to 10 parts by weight per 100 parts by weight of the resin. However, the addition of the charge controlling agent is not always essential. For example, triboelectric charging with carriers are utilized instead of the charge controlling agent in a two component type developing method, and triboelectric charge with a blade or sleeve member are utilized in a nonmagnetic blade coating mono component type developing method.

When the toner particles are prepared by a direct polymerization, initiators used include azo and diazo initiators, such as 2,2'-azobis-(2,4-dimethylvaleronitrile), 2,2'-azobisisobutyronitrile, 1,1'-azobis-(cyclohexane-1-carbonitrile), 2,2'-azobis- 4-methoxy-2,4-dimethylvaleronitrile), and azobisisobutyronitrile; and peroxide initiators, such as benzoyl peroxide, methyl ethyl ketone peroxide, diisopropyl peroxy carbonate, cumene hydroperoxide, 2,4-dichlorobenzoyl peroxide, and lauroyl peroxide. The content of the initiators added may be varied depending on the polymerization degree of the objective resin, and is generally 0.5 to 20 weight percent of the monomer. The suitable initiators may be selected depending on the polymerization process, referring to half-life period of ten hours, and may be used solely or as a mixture thereof.

Other additives including crosslinking agents, chain transfer agents, and inhibitors may be added to control the polymerization degree.

The toner particles of the present invention may be prepared, for example, by the following process: (1) Pulverizing method; after a binding resin, solid ester wax, coloring agent, charge controlling agent and so on are homogeneously dispersed in a pressurized kneader, extruder or media dispersion mixer, the dispersed mixture is pulverized into toner particles having a predetermined particle size mechanically or by bumping the mixture on a target in a jet stream, and the particle size distribution is adjusted by classification to obtain toner particles having a sharp particle size distribution: (2) A method for obtaining spherical toner particles by spraying a melt mixture into air with a disk or multi-fluid-nozzle as disclosed in Japanese Examined Patent No. 56-13945: (3) A method for making directly toner particles by a suspension polymerization described in Japanese Examined Patent No. 36-10231 and Japanese Laid-Open Patent Nos. 59-53856 and 59-61842: (4) A dispersion polymerization for forming directly toner particles by using a solvent which can dissolve the monomer, but cannot dissolve the resulting polymer: (5) An emulsion polymerization for forming toner particles, such as soap-free direct polymerization in the presence of a water-soluble polar initiator.

In the process for making toner particles by the pulverizing method, it is extremely difficult to control the shape of the toner particles. In the melt spraying method, the obtained toner generally has a wide particle size distribution, and much energy is consumed in the melting process.

Although the toner obtained by dispersion polymerization shows extremely sharp particle size distribution, usable raw materials are limited, and there are some problems due to the use of organic solvents, for example, the disposal of waste solvent, flammability of organic solvents, and a complicated apparatus. Emulsion polymerization represented by soap-free polymerization is available since a sharp particle size distribution of toner particles can be easily achieved. However, the emulsifier and initiator fragment used remain on the surface of the resulting toner particles, sometimes resulting in deterioration of environmental characteristics.

A preferred method for the toner production may be suspension polymerization, which can readily produce fine toner particles having a diameter of 3 to 8 μm and having a sharp particle size distribution because of easy control of the toner shape. Further, seed polymerization, in which further monomer molecules are adsorbed in the resulting polymer particles and again polymerized with an initiator, can also be preferred. In the seed polymerization, a polar compound can be dissolved or dispersed in the adsorbed monomer. When the toner is produced by suspension polymerization in the present invention, the toner particles can be directly produced by the following process: An ester wax, coloring agent, charge controlling agent, initiator, and other additives are added into a monomer. These components are uniformly dissolved or dispersed in a monomer by a homogenizer or ultrasonic agitator. The resulting monomer composition is dispersed into an aqueous medium containing a dispersant by a common agitator, homomixer or homogenizer. Agitation speed and time are preferably controlled to obtain a predetermined drop size of the monomer composition, in other words, a desirable toner particle size. Agitation is continued so that particles are stabilized by the effect of the dispersant added and sedimentation is prevented. The polymerization is carried out at a temperature of more than 40° C., and usually 50° to 90° C. The temperature can be raised at the second half step of the polymerization. Moreover, in order to remove unreacted monomer and by-products which cause odors during the toner fixing process, the aqueous medium may be partly evaporated at the second half step of the reaction or after the reaction. After the reaction, the resulting toner particles are washed, collected by filtration, and dried.

In the suspension polymerization, it is preferred that 300 to 3,000 parts by weight of water as the dispersion media per 100 parts by weight of the monomer composition is used. Examples of dispersant used include inorganic dispersants, such as calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina; organic dispersants, such as polyvinyl alcohol, gelatin, methyl cellulose, methylhydroxypropyl cellulose, ethyl cellulose, sodium salt of carboxymethyl cellulose, starch. The preferred amount of the dispersant ranges from 0.2 to 2.0 parts by weight per 100 parts by weight of the monomer.

These commercially available dispersants may be used as they are, and may be used after high speed agitation in the dispersion medium so as to obtain dispersant particles each having a fine uniform particle size. In the case of calcium phosphate, for example, a dispersant suitable for suspension polymerization may be prepared by mixing aqueous sodium phosphate and calcium chloride with high speed agitation. In order to provide a fine uniform particle size to the dispersant, 0.001 to 0.1 parts by weight of a surfactant may be added if necessary. Examples of surfactant may include commercial nonionic, anionic, and cationic surfactants. In particular, sodium dodecylsulfate, sodium tetradecylsulfate, sodium pentadecylsulfate, sodium octylsulfate, sodium oleate, sodium laurate, potassium stearate, and calcium oleate are preferred.

It is preferred that the toner of the present invention has a shape factor SF-1 of 100 to 160, and especially 100 to 150. The shape factor SF-1 is defined as the following equation:

$$\text{Shape factor } SF\text{-}1 = \frac{(MXLNG)^2}{\text{AREA}} \times \frac{\pi}{4} \times 100$$

wherein MXLNG represents the absolute maximum length of the toner particle, and AREA represents the projected area of the toner particle. The shape factor SF-1 is obtained by, for example, randomly selecting 100 toner particles which are enlarged to 500 times by Hitachi FE-SEM, S-800, and by analyzing information from each particle with Nileco image analyzer, LUZEX III, connected with the SEM through an interface. The shape factor SF-1 reflects circularity of the projected image or sphericity of the toner particle.

Toners having a shape factor SF-1 of more than 160 show a gradual tendency toward irregular shape from circular shape and a corresponding decrease in the transferring efficiency. When an intermediate transferring member is used, the transferring steps are repeated twice, so the decreased transferring efficiency causes the decrease in the utilization efficiency. Further, in recent digital full-color copying machines and digital full-color printers, after the color image from original document is subjected to color separation by blue (B), green (G), and red (R) filters, 20 to 70 μm of dot latent image is formed on the photosensitive member, and exact multi-color image of the original document including color information is reproduced by means of the subtracted color process using yellow (Y), magenta (M), cyan (C) and black (B) toners. Since substantial amounts of Y, M, C, B toners are loaded on the photosensitive member or intermediate transferring member in respect of color information of the document and CRT, each color toner used in the present invention must have significantly excellent transferring property. The aforementioned ester wax also may be preferably used in order to maintain such excellent transferring property of the toner. A more preferable toner has a shape factor of 100 to 160.

It is preferred in the present invention that another shape factor SF-2, which represents the irregularity of the surface of the toner particle, ranges from 100 to 130 to improve the transferring property of the toner. The second shape factor SF-2 is defined as the following equation:

$$\text{Shape factor } SF\text{-}2 = \frac{(PERIME)^2}{\text{AREA}} \times \frac{1}{4\pi} \times 100$$

wherein PERIME represents the periphery length of the toner particle, and AREA represents the projected area of the toner particle. Similarly to the shape factor SF-1, the shape factor SF-2 is obtained by, for example, randomly selecting 100 toner particles which are enlarged to 500 times by Hitachi FE-SEM, S-800, and by analyzing information from each particle with Nileco image analyzer, LUZEX III, connected with the SEM through an interface.

In order to obtain a further high definition image, in other words, to develop exactly fine latent image dots, it is preferred that the toner has a weight-average diameter of 3 μm to 8 μm and a coefficient of variation of the number of 35% or less, which are determined by a Coulter Counter. The toner having a weight-average diameter of less than 3 μm gives a low transferring efficiency, causes much residual toner on the photosensitive member and intermediate transferring member, resulting in nonuniform image due to fog and poor transferring. The toner having a weight-average diameter exceeding 8 μm brings about the decrease in resolution and dot reproducibility and adhesion to several members. Moreover, when the coefficient of variation of the number exceeds 35%, these drawbacks are further enhanced.

The particle size distribution of the toner may be determined by various method. In the present invention, a Coulter Counter was used. Coulter Counter TA-II, made by a Coulter Company, was connected with an interface, which was made by Nikkaki K. K. and an output and histogram of number and volume, and a canon CX-1 personal computer. Ca. 1% NaCl aqueous solution as an electrolytic solution was prepared from extra pure sodium chloride, for example, ISOTON II, made by Coulter Scientific Japan. Into 100 to 150 ml of the electrolytic solution, 0.1 to 5 ml of a surfactant, preferably an alkylbenzenesulfonate was added as a surfactant, and 2 to 20 mg of the sample is added. After the electrolytic solution containing suspended sample was dispersed for approximately 1 to 3 minutes by using an ultrasonic agitator, the particle size distribution of particles each having a particle size of 2 to 40 μ was determined by using the above-mentioned Coulter Counter TA-II with an aperture of 100 μm. The weight-average diameter and the coefficient of variation of the number was finally calculated from this measurement.

The coefficient of variation A of toner size distribution can be calculated by the following equation:

$$\text{Coefficient of variation } A = [S/D_1] \times 100$$

wherein S represents the standard deviation of the toner particle size, and $D_1$ represents the number-average particle size (μm).

As an preferred embodiment, the toner of the present invention may include any lubricative powder, such as Teflon powder, zinc stearate powder, and polyvinylidene fluoride; any abradant, such as cerium oxide, silicon carbide, and strontium titanate; any flowability improving agent, such as silica, titanium oxide, and aluminum oxide; any anti-caking agent; any electron conductive filler, such as carbon black, zinc oxide, and tin oxide. Between these additives, inorganic fine powders, such as fine silicate, titanium oxide, and aluminum oxide are preferably used. Further, it is preferred that the organic fine powders are subjected to hydrophobic treatment by using hydrophobic agents, such as silane coupling agents, silicone oils, and mixtures thereof. These additives are usually added by 0.1 to 5 parts by weight per 100 parts by weight of toner particles.

The toner of the present invention may be used as toner for mono component type developing agent or two component type developing agent.

An example of mono component type developing method is one which carries and charges magnetic toner particles in which magnetic material is contained in each toner particle by means of a developing sleeve having a magnet therein. When using nonmagnetic toner not containing a magnetic material, the toner particles may be carried by adhering toner particles on the developing sleeve which is forcibly charged by a coating blade, coating roll, or fur brush.

On the other hand, two component type developing agents use the toner of the present invention with a carrier. Although any carriers may be used without limitation, the preferred carriers include magnetic carriers comprising solely iron, nickel, or cobalt; and magnetic ferrite carriers formed from mixtures thereof. The shape of the carrier is also important to control a wide variety of saturation magnetization and electric resistance. For example, the shape is controlled to circular, oval, or irregular shape, and the fine structure of the carrier surface such as surface irregularity is controlled. The control is generally carried out in that carrier core particles are formed by calcination and granulation of the above-mentioned inorganic oxide and coated with a resin. The following methods are also available for the decrease in the load of the carrier to the toner; a method for obtaining a low density, dispersed carrier by mixing an inorganic compound and resin and pulverizing and classifying the mixture thereof; and a method for obtaining a spherical dispersed carrier by direct suspension polymerization of a mixture of the inorganic oxide and monomer in an aqueous medium.

A covered carrier is preferably used in which the surface of the carrier particles is covered with a resin. The following covering methods are applicable; a method in which the resin is dissolved or dispersed in a solvent and coated on the carrier; and a method in which the resin and carrier powders are merely mixed with each other.

Various materials may be used to cover the carrier particle surface depending on the toner material. Examples of suitable material include polytetrafluoroethylene, monochlorotrifluoroethylene polymers, polyvinylidene fluoride, silicone resins, styrene resins, acrylic resin, polyamide, polyvinyl butyral, aminoacrylate resins, and mixtures thereof. These materials are generally used by 0.1 to 30 weight percent, and preferably by 0.5 to 20 weight percent, in total to the carrier. The average particle size of carrier is desirably 10 to 100 μm, and preferably 20 to 50 μm.

Examples of the combination of the carrier with the resin are as follows: The surface of Cu—Zn—Fe ternary ferrite particle is coated with a mixture of a fluorine resin and styrene resin, such as polyvinylidene fluoride and styrene-methyl methacrylate, polytetrafluoroethylene and styrene-methyl methacrylate, and a fluorine copolymer and styrene copolymer, in which the ratio of the fluorine resin to the styrene resin ranges from 90:10 to 20:80, and preferably 70:30 to 30:70. The coated amount of the mixed resin ranges from 0.01 to 5 weight percent, and preferably 0.1 to 1 weight percent. The coated ferrite carrier has the above-mentioned average particle size, and contains 70% or more carrier particles which can pass through 250 mesh screen but not pass through 400 mesh screen. A typical example of the fluorine copolymer is a vinylidene fluoride/tetrafluoroethylene copolymer (10:90 to 90:10), and typical examples of the styrene copolymer are styrene/2-ethylhexyl acrylate (20:80 to 80:20) and styrene/2-ethylhexyl acrylate/methyl methacrylate terpolymer (20 to 60:5 to 30:10 to 50).

Such coated ferrite carriers provide a preferred triboelectric property to the toner of the present invention, and improve electrophotographic characteristics.

The concentration of the toner in the two component type developing agent comprising the toner and carrier is 2 to 15 weight percent, and preferably 4 to 13 weight percent.

The preferred magnetic properties of the magnetic carriers are as follows: The intensity of magnetization at 1,000 oersted after magnetic saturation, ($\sigma_{1000}$), ranges from 30 to 300 emu/cm$^3$, and 100 to 250 emu/cm$^3$ so as to obtain a higher quality of image. A higher quality of image cannot be readily obtained from the intensity of magnetization over 300 emu/cm$^3$, whereas the intensity of magnetization of less than 30 emu/cm$^3$ readily causes the carrier adhesion due to the decreased magnetic force.

The evaluation methods on image density, fog, coloring strength, low temperature fixing property, high temperature offset resistance, transparency, and blocking resistance of the toner will now be explained below.

Image Density

By using a modified commercial digital full-color copying machine CLC-500, made by Canon, in which a silicone oil painting unit is detached, 10000 times of repeated operations are carried out for a durability test. Image densities at the initial and final operations are measured with Macbeth Reflectance Densitometer made by Macbeth Co.

Fog

Using the modified copying machine which is the same as the machine used for image density evaluation, the whiteness levels of transferring paper before and after copying of a solid white image are measured with a reflectometer made by Tokyo Denshoku K. K. The fog is determined by the comparison of the whiteness levels of before and after copying or printing.

Coloring Strength

A toner coated with additives is prepared by mixing 100 parts by weight of toner and 0.1 to 3 parts by weight of additives, such as hydrophobic silica fine particles, hydrophobic titanium oxide fine particles, and hydrophobic alumina fine particles.

An unfixed image by the prepared toner is formed on transferring paper, SK paper, made by Nippon Seishi K. K., with a commercial copying machine, so that the weight of transferred toner on the solid image is approximately 0.55 mg/cm$^2$. An external fixer used is shown in FIG. 2, in which the external fixer has a fixing roll 1 having a diameter of 40 mm, which comprises a cylindrical core 5 having a temperature adjustable heater 6 therein, a silicone rubber layer 4 thereon having a thickness of 2 mm and a hardness of 30, and a PFA resin layer 3 thereon having a thickness of 50 μm; and a pressurizing roll 2 having a diameter of 50 mm, which comprises a cylindrical core 9 having a temperature adjustable heater 10 therein, a silicone rubber layer 8 thereon having a thickness of 1 mm, and a PFA resin layer 7 thereon having a thickness of 50 μm.

When using a nonmagnetic toner, the image density is measured by forming a fixed image having a gloss of 9, wherein the gloss is determined by incident light having an angle of incidence of 60 degrees. When using a magnetic toner, the image density is measured by forming a fixed image having a glow of 1. Each result is taken as the corresponding coloring strength. The gloss is measured by a handy gloss meter, Horiba Seisakusho Gloss Checker IG-310, and the image density is determined by Macbeth RD918.

Fixing Property and Offset Resistance

Figure 2:
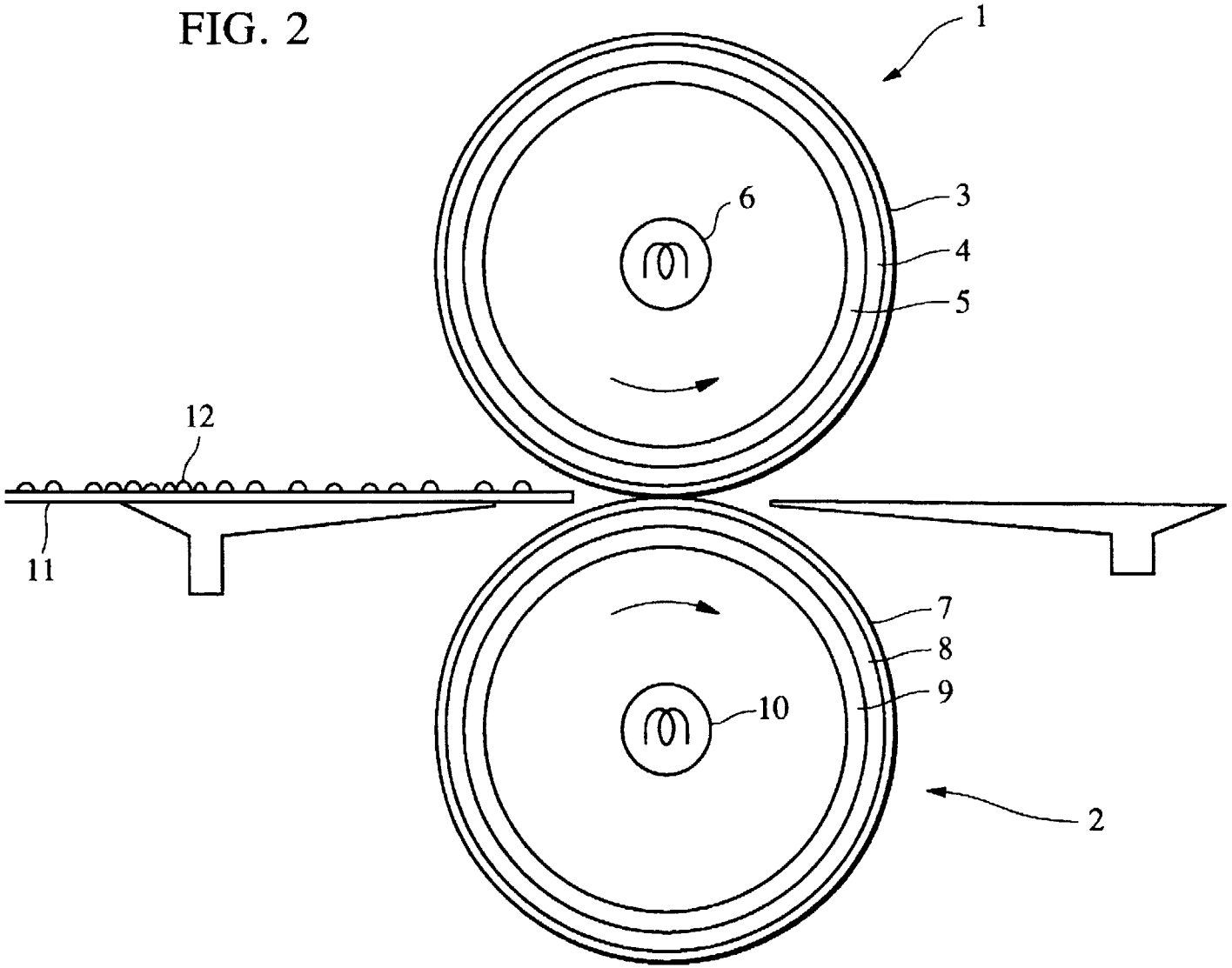
FIG. 2 is a schematic representation of an external fixer.

Unfixed images 12 having a transferred toner weight of 0.75 mg/cm$^2$ on transferring paper 11 are fixed with heat and pressure by using the external fixer as shown in FIG. 2. The nip between the fixing roll 1 and pressurizing roll 2 is adjusted to 7.0 mm. Each fixing is carried out at a fixing speed of 140 mm/sec. and at a temperature which is varied from 120° to 250° C. at an interval of 5° C.

In double-sided fixing, unfixed images 12 having a transferred toner weight of 0.75 mg/cm$^2$ on one side of the transferring paper 11 are fixed with heat and pressure, then unfixed images having a transferred toner weight of 0.75 mg/cm$^2$ on the other side of the transferring paper 11 are fixed with heat and pressure after turning the paper over.

For the evaluation of the fixing property, the fixed images including low temperature offset images are rubbed 10 times with a lens cleaning paper "Dasper (R)" made by Ozu Paper Co. Ltd., under the pressure of 50 g/cm$^2$. The fixing temperature is taken as the temperature in which the decreased density rate of after rubbing to before rubbing become less than 10%.

For evaluating the offset resistance, the starting point of offset at lower temperature and the end point of the offset at higher temperature are visually determined.

Blocking Resistance

Into a 100 cc of a polyethylene cup, 5 g of a toner containing predetermined additives are added and stood to allow in a desiccator at 50° C. for 3 days. The toner is classified into four particle size grades by a vibration screen classifier of a powder tester made by Hosokawa Micron Co. Ltd., in which three screens of 400,200, and 100 mesh are piled up by turns on a vibration table. The toner is placed on the top 100 mesh screen, and the classifier is shaken for approximately 15 seconds while the amplitude of the vibration table is adjusted within 0.5 mm by applying 15V of input voltage. Remaining toners on all the screens are weighed as aggregates, and the aggregation rate is calculated according to the following equation:

$$\text{Aggregation rate (\%)} = \frac{\text{Toner weight on 100 mesh screen}}{5\,g} \times 100 + \frac{\text{Toner weight on 200 mesh screen}}{5\,g} \times 100 \times \frac{3}{5} + \frac{\text{Toner weight on 400 mesh screen}}{5\,g} \times 100 \times \frac{1}{5}$$

The blocking resistance is evaluated based on the following standards from the increased aggregation rate, i.e. the difference between aggregation rate values of treated and untreated toners:

Good: 0 to 30% of increased aggregation rate;

Fair: 31 to 40% of increased aggregation rate;

No Good: 41% or more of increased aggregation rate

Transparency

An unfixed image on a OHP sheet (Trade name: CG3300 made by 3M) is fixed with heat and pressure under the conditions of nip of 7.0 mm, fixing speed 35 mm/sec, and fixing temperature of 180° C., to form the fixed image on the OHP sheet.

The transmittance and haze of the fixed image having a toner weight of 0.7 mg/cm$^2$ are measured, and the transparency is evaluated by using the result at the image density of 1.2.

The transmittance is measured with Shimadzu Spectrophotometer UV2200. Wavelengths used are 650 nm for magenta toner, 500 mm for cyan toner, and 600 mm for yellow toner, respectively, and each corresponds to the maximum absorbance of respective color. The transmittance of the OHP film not copied is taken as 100%.

Haze is determined with Haze Meter NDH-300A, made by Nihon Hasshoku Kogyo K. K.

EXAMPLES

The present invention will now be explained in detail based on the following illustrative examples.

Example

Into an attritor, 177 parts by weight of styrene monomer, 10 parts by weight of a cyan coloring agent, i.e. Copper Phthalocyanine pigment having an average primary particle size of 0.3 μm, and a negative charge controlling agent, i.e. a metallic compound of di-tert-butylsalicylic acid having an average first particle size of 0.3 μm were fed, and mixed in the presence of spherical zirconia particles of 2 mm diameter at 30° C. for 3 hours while stirring at 200 rpm. After the resulting mixture was transferred into another container, 23 parts by weight of n-butyl acrylate monomer, 10 parts by weight of a polar resin, i.e. saturated polyester resin formed from terephthalic acid and propylene oxide-modified bisphenol A (weight-average molecular weight: Ca. 7,000, acid value: Ca. 14 mgKOH/g), and 40 parts of solid ester wax (A-1) were added into the mixture, and were stirred for 2 hours at 60° C. with paddle mixing wings. It was confirmed that the solid ester wax (A-1) is dissolved, and the cyan coloring agent and negative charge controlling agent are homogeneously dispersed into the monomer.

After the agitator was exchanged to TK Homomixer made by Tokushu Kika Kogyo K. K., 12 parts by weight of 2,2'-azobis-(2,4-dimethylvaleronitrile) as an initiator was added into the container, and stirred for 1 minute at 200 rpm to prepare a monomer composition.

Into another container, 710 parts by weight of ion-exchanged water and 540 parts by weight of 0.1M $Na_3PO_4$ aqueous solution were added, heated to 60° C., and was stirred at 1200 rpm by using TK Homomixer made by Tokushu Kika Kogyo K. K. An aqueous medium containing fine $Ca_3(PO_4)_2$ particles was prepared by gradually adding 80 parts by weight of 1.3M $CaCl_2$ aqueous solution into the container.

The monomer composition was fed into the aqueous medium, and stirred with TK Homomixer for 10 minutes at 60° C. and 10,000 rpm in flowing nitrogen to granulate the monomer composition. While stirring with paddle stirring wings, the suspension was heated to 70° C. and allowed to polymerize for 11 hours to form styrene/n-butyl acrylate copolymer on the particle surface.

After suspension polymerization followed by cooling, hydrochloric acid was added to dissolve calcium phosphate. The cyan toner particles were obtained by filtration, washing with water, and drying. It was confirmed by TEM observation of the section of the cyan toner particles as shown in FIG. 1 that the ester wax (A-1) was encapsulated with the outer shell resin comprising styrene/n-butyl acrylate copolymer and the polar resin.

By mixing 100 parts by weight of the resulting cyan toner particles and 1.5 parts by weight of a hydrophobic silica having a specific surface area of 212 m$^2$/g by BET method, a negatively chargeable insulating cyan toner was prepared. The resulting cyan toner has a weight-average particle size of 6.4 μm, SF-1 of 111, and SF-2 of 115.

A two component type developer for magnetic brush developing was prepared by mixing 5 parts by weight of the resulting cyan toner and 95 parts by weight of a magnetic ferrite carrier coated with a silicone resin.

Examples 2 to 4

Insulating yellow, magenta, and black toners were prepared by a method similar to Example 1, but the coloring agent was changed from Copper Phthalocyanine pigment to C. I. Pigment Yellow 17 having an average first particle size of 0.3 μm, C. I. Pigment Red 202 having an average first particle size of 0.3 μm, a graft carbon black having an average first particle size of 0.05 μm, respectively. Physical properties of these color toners are shown in Table 2. Two component type developing agents for magnetic brush developing were also prepared similarly to Example 1.

TABLE 2

| | Weight-Average Particle Size (μm) | Coefficient of Variation at Size Distribution (%) | SF-1 | SF-2 | Ester Wax Content (pbw) per 100 pbw of Binding Resin | Outer-Shell Resin Mw | Outer-Shell Resin Mn | Volume Resistivity (Ω · cm) |
|---|---|---|---|---|---|---|---|---|
| Example 1 Cyan Toner | 6.4 | 24 | 111 | 115 | 20 | 60000 | 14000 | $\geqq 10^{14}$ |
| Example 2 Yellow Toner | 6.3 | 25 | 113 | 118 | 20 | 60000 | 13000 | $\geqq 10^{14}$ |
| Example 3 Magenta Toner | 6.1 | 28 | 115 | 119 | 20 | 61000 | 13500 | $\geqq 10^{14}$ |
| Example 4 Black Toner | 6.2 | 22 | 107 | 111 | 20 | 62000 | 13600 | $\geqq 10^{14}$ |

Evaluating Example 1

Two component type developing agents for magnetic brush developing, prepared in Examples 1 through 4, were introduced into a modified commercial digital full-color copying machine, Canon CLC-500, and unfixed and fixed images were produced by monochrome mode of each color while supplying toners.

Unfixed images, single-sided and double-sided fixed images, which were fixed with the external fixer were evaluated. The results are shown in Table 4.

Comparative Example 1

A cyan toner was prepared similarly to Example 1, but the following compound was used instead of the solid ester wax (A-1):

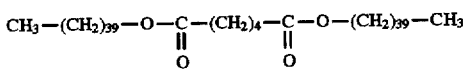

Results are shown in Table 4.

Comparative Example 2

A cyan toner was prepared similarly to Example 1, but the following compound was used instead of the solid ester wax (A-1). Results are shown in Table 4.

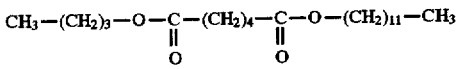

Comparative Example 3

A cyan toner was prepared to evaluate similarly to Example 1, but a low molecular weight polyethylene wax (Hoechst PE130) was used instead of the solid ester wax (A-1). Results are shown in Table 4.

Comparative Example 4

A cyan toner was prepared to evaluate similarly to Example 1, but a low molecular weight polypropylene wax (Viscol 550P made by Sanyo Chemical Industries, Ltd.) was used instead of the solid ester wax (A-1). Results are shown in Table 4.

Comparative Example 5

A cyan toner was prepared to evaluate similarly to Example 1, but a paraffin wax having a weight-average molecular weight of 550 was used instead of the solid ester wax (A-1). Results are shown in Table 4.

Comparative Example 6

A cyan toner was prepared to evaluate similarly to Example 1, but a montan ester wax E, made by Hoechst, mainly containing the compound represented by the following formula, was used instead of the solid ester wax (A-1). Results are shown in Table 4.

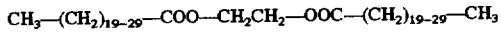

Examples 5 to 8

Insulating yellow, magenta, and black toners were prepared by a method similar to Examples 1 to 4, but the solid ester wax (A-6) was used instead of the solid ester wax (A-1). Physical properties and evaluation results of these color toners are shown in Table 3, and in Table 4, respectively.

Examples 9 to 12

Insulating yellow, magenta, and black toners were prepared by a method similar to Examples 1 to 4, but the solid ester wax (B-1) was used instead of the solid ester wax (A-1). Physical properties and evaluation results of these color toners are shown in Table 3, and in Table 4, respectively.

TABLE 3

| | Weight-Average Particle Size (μm) | Coefficient of Variation at Size Distribution (%) | SF-1 | SF-2 | Ester Wax Content (pbw) per 100 pbw of Binding Resin | Outer-Shell Resin Mw | Outer-Shell Resin Mn | Volume Resistivity (Ω · cm) |
|---|---|---|---|---|---|---|---|---|
| Example 5 Cyan Toner | 6.1 | 25 | 112 | 115 | 20 | 60000 | 14000 | $\geqq 10^{14}$ |
| Example 6 Yellow Toner | 6.2 | 25 | 113 | 116 | 20 | 61,000 | 13,500 | $\geqq 10^{14}$ |
| Example 7 Magenta Toner | 6.1 | 26 | 114 | 118 | 20 | 60,500 | 13500 | $\geqq 10^{14}$ |
| Example 8 Black Toner | 6.0 | 21 | 110 | 115 | 20 | 62,000 | 13,500 | $\geqq 10^{14}$ |
| Example 9 Cyan Toner | 6.3 | 23 | 115 | 120 | 20 | 61,000 | 14,000 | $\geqq 10^{14}$ |

TABLE 3-continued

| | | Weight-Average Particle Size (μm) | Coefficient of Variation at Size Distribution (%) | SF-1 | SF-2 | Ester Wax Content (pbw) per 100 pbw of Binding Resin | Outer-Shell Resin Mw | Outer-Shell Resin Mn | Volume Resistivity (Ω · cm) |
|---|---|---|---|---|---|---|---|---|---|
| Example 10 | Yellow Toner | 6.2 | 26 | 113 | 119 | 20 | 60,500 | 13,000 | $\geqq 10^{14}$ |
| Example 11 | Magenta Toner | 6.3 | 27 | 114 | 118 | 20 | 61,000 | 13,500 | $\geqq 10^{14}$ |
| Example 12 | Black Toner | 6.2 | 23 | 108 | 112 | 20 | 62,500 | 14,000 | $\geqq 10^{14}$ |

TABLE 4

| | Image Density | | Fog | | | | Offset Resistance at Single-Sided Fixing | | | Offset Resistance at Double-Sided Fixing | | | | Fixed Image on OHP Film | |
|---|---|---|---|---|---|---|---|---|---|---|---|---|---|---|---|
| | Initial | After Endurance | Initial (%) | After Endurance (%) | Coloring Strength | Fixing Temp. (°C.) | Starting Point (°C.) | End Point (°C.) | Non-Offset Temperature Range (°C.) | Starting Point (°C.) | End Point (°C.) | Non-Offset Temperature Range (°C.) | Blocking Resistance | Transparency | Haze |
| Cyan Toner of Ex. 1 | 1.42 | 1.41 | 1.0 | 1.0 | 1.42 | 155 | 155 | 210 | 55 | 155 | 205 | 50 | Good | 65 | 24 |
| Yellow Toner of Ex. 2 | 1.43 | 1.42 | 1.0 | 1.0 | 1.43 | 155 | 155 | 210 | 55 | 155 | 205 | 50 | Good | 65 | 22 |
| Magenta Toner of Ex. 3 | 1.42 | 1.41 | 0.9 | 0.9 | 1.42 | 155 | 155 | 210 | 55 | 155 | 205 | 50 | Good | 64 | 23 |
| Black Toner of Ex. 4 | 1.43 | 1.42 | 1.1 | 1.0 | 1.43 | 155 | 155 | 210 | 55 | 155 | 205 | 50 | Good | — | — |
| Cyan Toner of Comp. Ex. 1 | 1.31 | 1.21 | 8.1 | 9.9 | 1.31 | 155 | 155 | 220 | 65 | 155 | 210 | 55 | No Good | 33 | 51 |
| Cyan Toner of Comp. Ex. 2 | 1.38 | 1.30 | 2.0 | 3.0 | 1.39 | 155 | 155 | 175 | 20 | 155 | 165 | 10 | Good | 51 | 31 |
| Cyan Toner of Comp. Ex. 3 | 1.17 | 1.03 | 2.2 | 3.3 | 1.18 | 155 | 155 | 185 | 30 | 160 | 180 | 20 | Fair | 27 | 57 |
| Cyan Toner of Comp. Ex. 4 | 1.15 | 1.08 | 2.3 | 2.7 | 1.15 | 155 | 155 | 185 | 30 | 155 | 180 | 25 | Fair | 31 | 54 |
| Cyan Toner of Comp. Ex. 5 | 1.40 | 1.31 | 2.5 | 3.3 | 1.40 | 155 | 155 | 210 | 55 | 155 | 200 | 45 | Fair | 40 | 45 |
| Cyan Toner of Comp. Ex. 6 | 1.35 | 1.27 | 5.8 | 7.7 | 1.35 | 155 | 155 | 205 | 50 | 155 | 200 | 45 | Good | 50 | 32 |
| Cyan Toner of Ex. 5 | 1.45 | 1.44 | 0.9 | 1.0 | 1.45 | 155 | 155 | 225 | 70 | 155 | 220 | 65 | Good | 70 | 20 |
| Yellow Toner of Ex. 6 | 1.44 | 1.43 | 0.9 | 0.9 | 1.44 | 155 | 155 | 225 | 70 | 155 | 220 | 65 | Good | 68 | 21 |
| Magenta Toner of Ex. 7 | 1.44 | 1.44 | 0.9 | 1.0 | 1.44 | 155 | 155 | 225 | 70 | 155 | 220 | 65 | Good | 69 | 21 |
| Black Toner of Ex. 8 | 1.45 | 1.45 | 0.9 | 0.8 | 1.45 | 155 | 155 | 225 | 70 | 155 | 220 | 65 | Good | — | — |
| Cyan Toner of Ex. 9 | 1.46 | 1.46 | 1.0 | 1.0 | 1.46 | 155 | 155 | 215 | 60 | 155 | 210 | 55 | Good | 63 | 27 |
| Yellow Toner of Ex. 10 | 1.46 | 1.45 | 0.9 | 0.9 | 1.46 | 155 | 155 | 215 | 60 | 155 | 210 | 55 | Good | 63 | 27 |
| Magenta Toner of Ex. 11 | 1.47 | 1.45 | 0.8 | 0.9 | 1.47 | 155 | 155 | 215 | 60 | 155 | 210 | 55 | Good | 63 | 27 |
| Black Toner of Ex. 12 | 1.46 | 1.45 | 0.9 | 1.0 | 1.46 | 155 | 155 | 215 | 60 | 155 | 210 | 55 | Good | — | — |

Evaluating Example 2

By using various toners prepared in Examples 1 through 4 and Examples 5 through 8, fixing property, offset resistance, and color mixing properties of the images, obtained from full-color mode copying, were evaluated with the external fixer. Both single-sided fixing and double-sided fixing shows satisfactory results, and the obtained full-color images are faithful to the respective original document.

What is claimed is:

1. A toner for developing an electrostatic image, comprising:

toner particles containing a binding resin composed of a styrene homopolymer or copolymer, a coloring agent, a polar resin, and a solid ester wax represented by the following general formula (A) or (B):

$$R_1-O-\underset{\underset{O}{\|}}{C}-R_2-\underset{\underset{O}{\|}}{C}-O-R_3 \quad (A)$$

wherein $R_1$ and $R_3$ represent organic groups each having 6 to 32 carbon atoms, $R_1$ and $R_3$ may be the same or different, and $R_2$ represents an alkylene group having 4 to 20 carbon atoms:

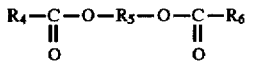

(B)

wherein $R_4$ and $R_6$ represent organic groups each having 6 to 32 carbon atoms, $R_4$ and $R_6$ may be the same or different, and $R_5$ represents an organic group selected from the group consisting of the following groups (1), (2), and (3):

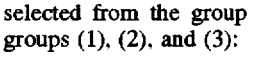

(1);

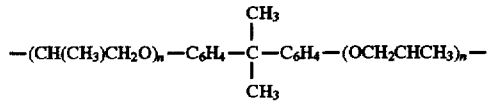

(2)

wherein n represents an integer not less than 1;

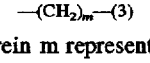

(3)

wherein m represents an integer of 4 to 20.

2. The toner according to claim 1, wherein said toner particles comprise coloring resin particles containing the binding resin composed of a styrene homopolymer or copolymer formed by dispersing a monomer composition containing at least monomers containing styrene, the coloring agent, the polar resin and the solid ester wax into an aqueous medium so as to form particles of the monomer composition; and by polymerizing the monomer in the particles of the monomer composition.

3. The toner according to claim 2, wherein said toner particles have a shape factor SF-1 of 100 to 150 and a shape factor SF-2 of 100 to 130.

4. The toner according to claim 2, wherein said monomers are styrene and acrylic ester, and said polar resin is a polyester resin.

5. The toner according to claim 2, wherein said monomers are styrene and methacrylic ester, and said polar resin is a polyester resin.

6. The toner according to claim 1, wherein said toner particles have a shape factor SF-1 of 100 to 150 and a shape factor SF-2 of 100 to 130, and said ester wax is encapsulated inside the toner particle by an outer shell resin layer formed from the binding resin and polar resin.

7. The toner according to claim 6, wherein said binding resin is a styrene/acrylic ester copolymer, and said polar resin is a polyester resin.

8. The toner according to claim 6, wherein said binding resin is a styrene/methacrylic ester copolymer, and said polar resin is a polyester resin.

9. The toner according to claim 1, wherein $R_1$ and $R_3$ are alkyl groups.

10. The toner according to claim 1, wherein $R_4$ and $R_6$ are alkyl groups.

11. The toner according to claim 1, wherein 5 to 40 parts by weight of said solid ester wax is contained per 100 parts by weight of the binding resin.

12. The toner according to claim 1, wherein 10 to 30 parts by weight of said solid ester wax is contained per 100 parts by weight of the binding resin.

13. The toner according to claim 1, wherein said toner particles are nonmagnetic cyan toner particles.

14. The toner according to claim 1, wherein said toner particles are nonmagnetic yellow toner particles.

15. The toner according to claim 1, wherein said toner particles are nonmagnetic magenta toner particles.

16. The toner according to claim 1, wherein said toner particles are nonmagnetic black toner particles.

17. The toner according to claim 1, wherein said solid ester wax has a melting point of 40° to 90° C.

18. The toner according to claim 1, wherein said solid ester wax has a melting point of 55° to 85° C.

19. The toner according to claim 1, wherein said solid ester wax has a solubility parameter (SP) of 7.5 to 10.5.

20. The toner according to claim 1, wherein said solid ester wax has a melt viscosity, at 130° C., of 1 to 300 cPs.

21. The toner according to claim 1, wherein said solid ester wax has a melt viscosity, at 130° C., of 3 to 50 cPs.

22. The toner according to claim 1, wherein said solid ester wax has a Vickers hardness of 0.3 to 5.0.

23. The toner according to claim 1, wherein said solid ester wax has a Vickers hardness of 0.5 to 3.0.

* * * * *

UNITED STATES PATENT AND TRADEMARK OFFICE

CERTIFICATE OF CORRECTION

PATENT NO. : 5,712,072

DATED : January 27, 1998

INVENTOR(S) : KOHJI INABA ET AL.

It is certified that error appears in the above-identified patent and that said Letters Patent is hereby corrected as shown below:

On the title page,

[73] ASSIGNEE

"Canon Kabusbiki Kaisha" should read --Canon Kabushiki Kaisha--.

COLUMN 1

Line 16, "print;" should read --print:--.
Line 48, "steps;" should read --steps:--.
Line 52, "intermediated" should read --intermediate--.

COLUMN 2

Line 6, "self cohesive" should read --self-cohesive--.
Line 53, "waited" should read --awaited--.

COLUMN 3

Line 51,

" 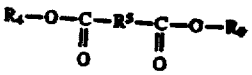 (B) "

should read

-- $R_4-\underset{\underset{O}{\|}}{C}-O-R_5-O-\underset{\underset{O}{\|}}{C}-R_6$ --.

(B)

UNITED STATES PATENT AND TRADEMARK OFFICE

CERTIFICATE OF CORRECTION

PATENT NO. : 5,712,072

DATED : January 27, 1998

INVENTOR(S) : KOHJI INABA ET AL.

It is certified that error appears in the above-identified patent and that said Letters Patent is hereby corrected as shown below:

COLUMN 4

Line 24, "

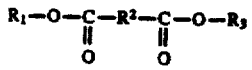

(A) "

should read

-- $R_4-\underset{\underset{O}{\|}}{C}-O-R_5-O-\underset{\underset{O}{\|}}{C}-R_6$ (B) --.

COLUMN 5

Line 4, "soled" should read --solid--.
Line 7, "the" should be deleted.
Line 12, "two" should read --two---.
Line 63, "tends" should read --tend--.

COLUMN 6

Line 23, "steps;" should read --steps:--.

UNITED STATES PATENT AND TRADEMARK OFFICE

CERTIFICATE OF CORRECTION

PATENT NO. : 5,712,072

DATED : January 27, 1998

INVENTOR(S) : KOHJI INABA ET AL.

It is certified that error appears in the above-identified patent and that said Letters Patent is hereby corrected as shown below:

COLUMN 7

Line 9, "TABLE 1" should read
--The physical properties of these solid ester waxes are shown in Table 1.
TABLE 1--.

COLUMN 8

Line 14, "more" should read --more, and--.
Exhibit B-2," In "Solid ester wax (B-2)", "—$(CH_2)_{20}$—" should read --—$(CH_2)_{16}$)—- (both occurrences).

COLUMN 9

Line 16, "methods;" should read --methods:--.
Line 17, "an" should read --a--; and "a" should read --and--.
Line 57, "follows;" should read --follows:--.

COLUMN 11

Line 8, "naphtoic" should read --naphthoic--.

UNITED STATES PATENT AND TRADEMARK OFFICE

CERTIFICATE OF CORRECTION

PATENT NO. : 5,712,072

DATED : January 27, 1998

INVENTOR(S) : KOHJI INABA ET AL.

It is certified that error appears in the above-identified patent and that said Letters Patent is hereby corrected as shown below:

COLUMN 14

Line 11, "method." should read --methods.--.
Line 12, "Coulter" (first occurrence) should read --A Coulter--; and "a" should be deleted.
Line 15, "canon CX-1" should read --Canon CX-1--.
Line 37, "an" should read --a--.

COLUMN 15

Line 9, "toner;" should read --toner:--.
Line 18, "applicable;" should read --applicable:--.

COLUMN 16

Line 66, "become" should read --becomes--.

COLUMN 17

Line 10, "400,200," should read --400, 200,--.
Line 46, "500 mm" should read --500 nm--; and "600 mm" should read --600 nm--.

COLUMN 21

Table 4, In "Yellow Toner of Ex. 10" under "Haze" column:, "27" should read --28--.
Line 63, "shows" should read --show--.

UNITED STATES PATENT AND TRADEMARK OFFICE

CERTIFICATE OF CORRECTION

PATENT NO. : 5,712,072

DATED : January 27, 1998

INVENTOR(S) : KOHJI INABA ET AL.

It is certified that error appears in the above-identified patent and that said Letters Patent is hereby corrected as shown below:

COLUMN 23

Line 20, "—$(CH_2)_m$—(3)" should read ---—$(CH_2)_m$- (3)--

Signed and Sealed this

Fifteenth Day of September, 1998

*Attest:*

Bruce Lehman

BRUCE LEHMAN

*Attesting Officer*

*Commissioner of Patents and Trademarks*